United States Patent [19]

Svoboda

[11] 4,229,020

[45] Oct. 21, 1980

[54] SAFETY STRAP FOR SKIS

[75] Inventor: Josef Svoboda, Schwechat, Austria

[73] Assignee: TMC Corporation, Baar, Switzerland

[21] Appl. No.: 957,087

[22] Filed: Nov. 2, 1978

[30] Foreign Application Priority Data

Nov. 7, 1977 [AT] Austria ..... 7911/77

[51] Int. Cl.[3] ..... A63C 9/086

[52] U.S. Cl. ..... 280/618; 280/637

[58] Field of Search ..... 280/637, 636, 613, 618

[56] References Cited

U.S. PATENT DOCUMENTS

| | | | |
|---|---|---|---|
| 3,865,389 | 2/1975 | Delery | 280/637 |
| 3,998,474 | 12/1976 | Marker et al. | 280/637 |
| 4,065,151 | 12/1977 | Weinstein et al. | 280/637 |

FOREIGN PATENT DOCUMENTS

| | | | |
|---|---|---|---|
| 2417892 | 10/1975 | Fed. Rep. of Germany | 280/637 |
| 227994 | 10/1943 | Switzerland | 280/637 |

*Primary Examiner*—David M. Mitchell

*Attorney, Agent, or Firm*—Blanchard, Flynn, Thiel, Boutell & Tanis

[57] ABSTRACT

A safety strap storage construction wherein a base plate is secured to the ski and a support plate is releasably coupled to the base plate. A ski boot is adapted to be mounted onto the support plate and remains in engagement with the ski boot during a release of the ski boot from engagement with the ski. A safety strap is provided in a cavity between the base plate and the support plate and is secured at one end thereof to the base plate and at the other end thereof to the support plate. A safety strap tensioning construction is mounted on the base plate to keep the safety strap taut while stored in the cavity between the base plate and the support plate. The mechanism for maintaining the safety strap in a taut condition can be a shiftable disk resiliently biassed to maintain the safety strap wound therearound in a taut condition or a plurality of clips or the like can be fixedly attached to the base plate with the safety strap being threaded therearound.

9 Claims, 10 Drawing Figures

FIG. 1
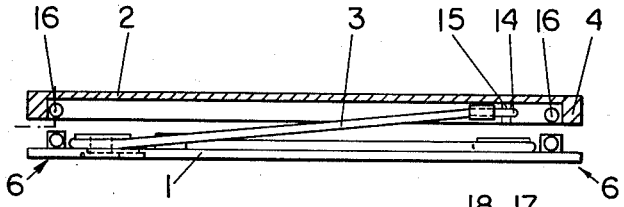
FIG. 2
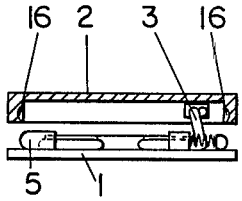
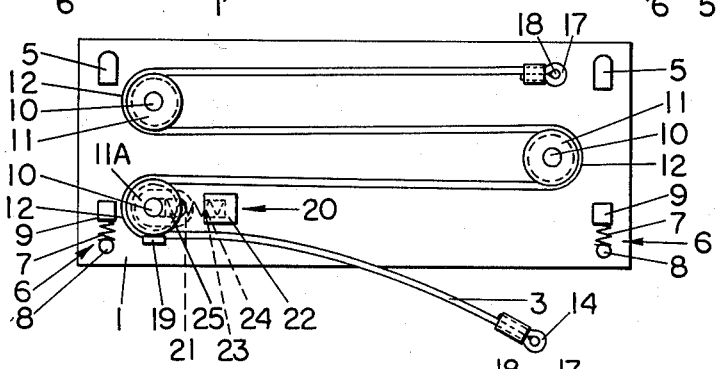
FIG. 3
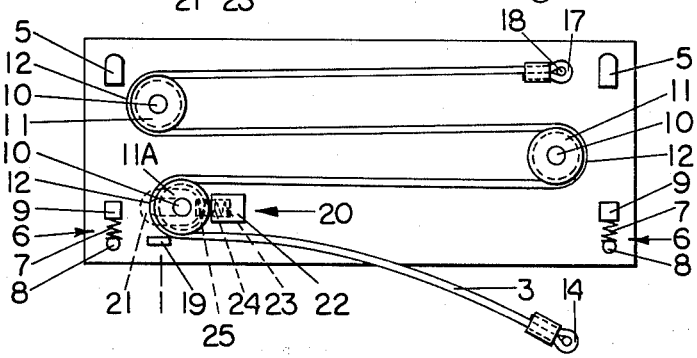
FIG. 3a
FIG. 4
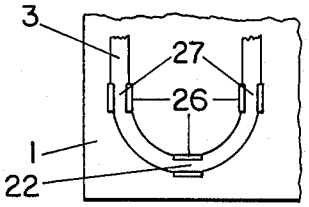
FIG. 6
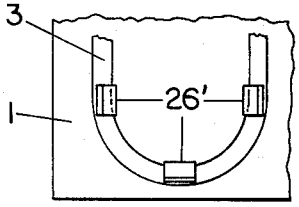
FIG. 8
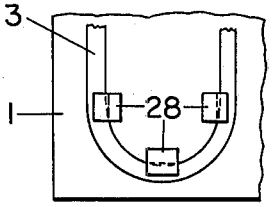
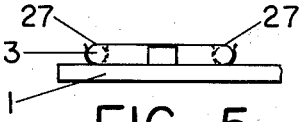
FIG. 5
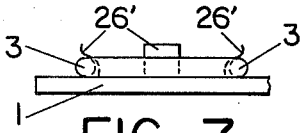
FIG. 7
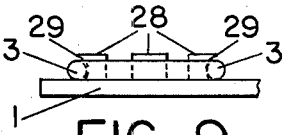
FIG. 9

SAFETY STRAP FOR SKIS

FIELD OF THE INVENTION

The invention relates to a safety strap for skis, which is arranged in the downhill position between a ski-fixed base plate and between a ski boot-fixed support plate and maintains a connection between the ski boot and the ski after the ski boot has been released from the ski.

BACKGROUND OF THE INVENTION

Such constructions are known in various forms. For example, reference is made to German OS No. 2,212,494, in which the sole plate is held connected to the ski by means of a resilient strap also after a release operation. However, the end of the strap which is associated with the ski is anchored in a ski-fixed binding part. This and similar constructions have the disadvantage that only a relatively short strap can be stored in the ski binding part or between a base plate and a support plate, which easily results in injuries to the skier. It is also known to use a longer safety strap, as one can take it for example from Swiss Pat. No. 588,187. This construction has in turn the disadvantage that relatively long strap parts must be guided self-supportingly. This increases the danger of the strap getting caught on obstacles which project from the ground during the downhill skiing.

The invention has the purpose of providing a storage of a safety strap with longer dimension between the base plate and the support plate, without utilizing complicated resilient devices for winding and unwinding and still at a length which is sufficient to prevent both injuries to the skier and also injuries to third persons.

BRIEF DESCRIPTION OF THE DRAWINGS

Further advantages, details and inventive characteristics of the invention will now be discussed more in detail with reference to the drawings, which illustrates four exemplary embodiments.

In the drawings:

FIGS. 1 and 2 are associated views of the inventive device, namely, a side view and an end view, respectively;

FIG. 3 is a top view of a base plate in a position exposed from the support plate with a tensioned strap;

FIG. 3*a* is a top view of a similar position (with a loosened strap); and

FIGS. 4 to 9 illustrate top and end views of three different embodiments of the holding parts in the support plate for the strap.

DETAILED DESCRIPTION

In the first exemplary embodiment according to FIGS. 1 to 3, a rectangular base plate 1 adapted to be secured to a ski by means not illustrated and a support plate 2 having dimensions which substantially correspond with the base plate are illustrated. The support plate 2 rests thereby according to FIGS. 1 and 2 snugly on the base plate 1 and is adapted to be secured to a ski boot by means not illustrated; these structural parts have been shown in the drawing with a spacing therebetween for a better understanding. The support plate 2 has a downwardly depending flange 4 which extends along its periphery. The base plate 1 has holding parts 5 and locking means 6, which lie substantially close-fittingly within the insides of the peripheral flange 4 on the support plate 2, so that, when the support plate 2 is placed onto the base plate 1, the first one is held supported on the latter one. The individual locking means 6 include a spiral compression spring 7 and a locking ball 8 which is enclosed within one end of the spring 7. The end of the spring 7 remote from the ball 8 is anchored in a mounting member secured to the base plate 1. The balls 8 and holding parts 5 are each received in recesses 16 on the inside of the downwardly extending peripheral flange 4 on the support plate 2 to releasably connect the support plate 2 to the base plate 1.

Disks 11 and 11A are of equal diameter and have approximately semicircularly shaped grooves 12 arranged on substantially vertical shafts 10 on the base plate 1, the radii of which grooves permit both receiving of a strap 3 and a secure holding thereof during the tensioned storage of the strap 3 and also assures a secure release of the strap 3 during a loosening of same. For this purpose, the shafts 10 for the disks 11 and 11A are arranged on the base plate 1 such that the strap 3 has substantially parallel reaches which extend parallel to the longitudinal axis of the base plate 1. Thus, the lateral spacing between the two shafts 10 for the disks 11 and 11A in a direction perpendicular to the longitudinal axis of the ski is equal to twice the diameter of one disk. Further, the lateral spacing between each of the shafts in a direction perpendicular to the longitudinal axis of the ski is equal to the diameter of one disk. Both ends of the strap 3 terminate in loops 14 and 17. The loop 14 is secured to the underside of the support plate 2 by means of a pin 15 (compare FIGS. 1 and 2), which end (with the loop 14) is exposed in FIGS. 3 and 3*a* in order to show that the end is secured or must be secured not to the base plate 1 but to the support plate 2. The other end of the strap 3, which end has the loop 17, is secured by means of a different pin 18 to the base plate 1.

As is best illustrated in FIG. 3, to clamp the strap 3 on the base plate 1, a clamp, a block 19 or the like is provided in the area of the last disk 11 which will yet be identified in more detail. The term "last disk" 11 is to be understood as being that disk viewed starting with the fastening of the loop 17 by means of the pin 18 to the base plate 1 and following the strap toward the loop 14 in direction of unwinding of the strap. In this embodiment, the "last disk" on the base plate 1 is the disk 11A. The arrangement of the clamp, the block 19 or the like in the area of the last disk 11A permits a clamping of the strap 3 between these two structural parts, as this can be taken from FIG. 3. Since the end of the strap 3 which is exposed in FIG. 3 is secured in reality to the inside of the support plate 2—as one can take from FIGS. 1 and 2—this strap piece too lies substantially in tensioned condition between its clamped point (between the disk 11A and the clamp 19) and its end (loop 14) which is secured to the support plate 2. The "substantially" tensioned condition means here that a certain looseness must exist, which corresponds with the length which results from the distance for placing the support plate 2 on the base plate 1. The looseness can be eliminated by using a tensioning device 20 which will be described more in detail hereinafter.

The tensioning device which is identified as a whole by the reference numeral 20 includes a longitudinal slot 21 in the base plate 1 for receiving the shaft 10 of the last disk 11A therein. In the present exemplary embodiment, the longitudinal extent of the longitudinal slot 21 lies parallel with respect to the longitudinal axis of the ski. An abutment member 22 is secured to the base plate 1 in direction of the last strap part—which extends inclined upwardly in the cavity existing between the base plate 1 and the support plate 2. The abutment member 22 and a portion of the last disk 11A, which portion opposes the abutment member 22, each have a recess 23 and 25 therein in which is received the ends of a compression spring 24. The compression spring 24 resiliently urges the last disk 11A away from the abutment member 22 into the position shown in FIG. 3. However, if the strap 3 is tensioned, as is illustrated in FIG. 3*a*, then, during an overcoming of the force of the compression spring 24, the last disk 11A is pulled until it hits the abutment member 22. This position is shown in FIG. 3*a*. It corresponds both with the situation which is created due to the strap 3 being "threaded" prior to the support plate 2 being mounted on the base plate 1, and also the situation when the support plate 2 is lifted off away from the base plate 1 during an overload or release of the ski boot from the ski. The force of the compression spring 24 is dimensioned such that it must overcome only the frictional resistance which is caused in the clamping device both by the strap 3 between the clamp 19 and the last disk 11A. Therefore, the force of the compression spring 24 plays practically no role in the release operation, so that in measuring the adjusting force for the main spring (for holding down the support plate on the ski) this force can be neglected. The clamping device 20 can also be designed such that the last disk 11A is biassed by a tension spring, which can then preferably be secured to the mounting member 9. In this manner, a separate abutment member and the openings in same and in a portion of the last disk 11A are not needed; a small opening in the underside of the last disk 11A and in the associated mounting member 9 is sufficient, into which opening each end of the tension spring can be attached. It is also possible, in order to store the tension spring, to provide a groove in the base plate (approximately in the location of the longitudinal slot 21).

FIGS. 4 to 9 illustrate in associated views three further different embodiments for holding the strap 3 on the base plate 1, wherein FIGS. 4, 6 and 8 are each a top view and FIGS. 5, 7 and 9 are each an end view.

In the exemplary embodiment according to FIGS. 4 and 5, two-arm spring-steel clips 26 are secured on the base plate 1, the open slots 27 of which serve to receive and to resiliently hold down the inserted strap 3. The width of the individual spring-steel clips 26 is dimensioned such that the strap 3 can easily be pulled out through the slots 27 during a stress, however, being sufficient to hold down the strap 3 in the threaded-in position. In order to prevent a jamming or snagging at the free ends of the individual springsteel clips 26, these can also have a curved contour, wherein the radius of curvature corresponds with the extent of the strap 3.

In the embodiment according to FIGS. 6 and 7, one-arm spring-steel clips 26' are provided in a similar arrangement as in the exemplary embodiment according to FIGS. 4 and 5. The strap 3 is placed or threaded around these similar to the disks 11. During a stress or pull on the strap 3, the strap 3 is pulled out of a clip (not shown), similar to the exemplary embodiment according to FIGS. 1 to 3*a*, after which the strip 3 is released from the other spring-steel clips 26'.

In the exemplary embodiment according to FIGS. 8 and 9, plural blocks 28 are provided on the base plate 1. The blocks 28 are each formed on their outer sides 29 (compare FIG. 9) which come into contact with the strap 3 with a radius, which is larger than the radius of the strap 3. The curvature of the outer sides 29 extends slightly above the inserted strap 3, so that the strap 3 can be easily placed into the receiving points which are formed by the outer sides 29, if necessary (in case of a release), however, can also easily be removed therefrom.

The invention is not to be limited to the illustrated exemplary embodiments. Further modifications can be made without departing from the scope of the invention. It has already been mentioned that the clamping device can utilize if desired a tension spring in place of a compression spring. It is also easily conceivable to use the clamping device in one of the exemplary embodiments according to FIGS. 4 and 5 or 6 and 7 or 8 and 9. For this purpose, the mountings 26, 26' or 28 are then arranged on a separate holding part, similar with the last disk according to FIGS. 1 to 3*a*, which is movable in relationship to the base plate against the force of a spring in longitudinal direction of the ski. However, a combined arrangement can also be made, for example such that in place of the last disk one of the mountings according to the further exemplary embodiments is provided. In this case, it is possible to give up a separate clamp and, if desired, for example in the embodiment according to FIGS. 4 and 5, the separate clamping device, because the three spring-steel clips are sufficient for a taut tightening of the strap.

A further possibility consists in the mountings for the strap not being arranged on the base plate, but on the support plate. In this case, special care is taken for a secure clamping of the tensioned strap, in order to prevent the strap from being released from the mountings on the support plate during a placement of the support plate onto the base plate and also during use. For this purpose, it will be advantageous to use a slightly more tight spring-steel clip in the embodiment according to FIGS. 4 and 5. An advantage of this arrangement lies furthermore in the moving-away support plate (with the ski boot and the skier) possibly tearing loose during a fall, which causes the strap to simply be wound off from the mountings, for example from the grooves of the individual disks, since after the strap is released from the holding clamp, the strap is no longer held by any force in or on the mountings.

Regarding the material of the strap, requirements must be met in as far as these are determined by rigidity, conformity (deformation) and weather resistance (coldness, wetness). One will preferably use a strap which is formed from steel wires or made of a plastic strap for example of nylon.

Although particular preferred embodiments of the invention have been disclosed in detail for illustrative purposes, it wil be recognized that variations or modifications of the disclosed apparatus, including the rearrangement of parts, lie within the scope of the present invention.

The embodiments of the invention in which an exclusive property or privilege is claimed are defined as follows:

1. In a safety strap for a ski arranged between a ski-fixed base plate and a ski boot-fixed support plate and maintaining, following a release of a ski boot, a connection between said ski boot and said ski, wherein the improvement comprises releasable connecting means for releasably connecting said base plate and said support plate together, holding elements on one of said base plate and said support plate, said holding elements being spaced from one another both in longitudinal direction of said ski and also laterally thereof, a strap wound around said holding elements along its longitudinal extent, said strap being secured at one of its ends to said support plate and at its other end to said base plate, a part of said strap extending from said holding elements to a fastening point on the other of said base plate and said support plate and holding means for holding said strap normally in a tensioned condition on said holding elements and allowing release of said strap from said holding elements when said boot is released from said ski.

2. The safety strap according to claim 1, wherein said holding elements are arranged in a cavity between said base plate and said support plate, wherein said cavity is formed by a recess in a one of said plates, which is free of holding elements on which rests said strap, and wherein the recess-free plate has said releasable connecting means, on which the other plate can rest and be releasably held thereto.

3. The saftey strap according to claim 1, wherein said holding elements are disks which are secured on shafts extending perpendicularly to said plates, wherein said shafts are secured to one of said base plate and said support plate and the individual disks which are arranged in series in direction of the strap are arranged spaced apart transversely with respect to the longitudinal axis of the ski, in which the lateral spacing between said shafts corresponds substantially with the diameter of one disk so that the reaches of said strap extend parallel to the longitudinal axis of said ski.

4. The safety strap according to claim 1, wherein said holding elements are formed by springsteel clips or blocks arranged forming preferably and substantially the circumference of one disk, and wherein the strap is held tensioned in said clamps or blocks by a jamming of at least one clamp.

5. The safety strap according to claim 3, wherein said holding means includes a clamping device, wherein said part of said strap is held by said clamping device on one of said holding elements supported on a mounting member which is movable against a spring force acting along the longitudinal axis of the ski, wherein said strap is removable from said holding elements when said movable holding element is shifted away from said clamping device.

6. The safety strap according to claim 5, wherein said holding means includes a longitudinal slot in the plate having said shaft therein, and wherein, viewed along the longitudinal axis of the ski, an abutment member is arranged adjacent one end of the slot, and a tensioning spring, providing said spring force, is provided between same and said shaft.

7. The safety strap according to claim 6, wherein said shaft is biassed by said tensioning spring suspended with its one end on a mounting for one of said holding elements and its other end on said abutment member.

8. The safety strap according to claim 1, wherein said holding elements, in vertical cross section, have concave recesses for receiving said strap, and wherein said strap has a cross-sectional radius, said strap radius being slightly smaller than a radius of said recesses in the individual holding elements, on which it is held in tension, and said strap being one of individual steel wires, plastic, or nylon.

9. The safety strap according to claim 2, wherein said releasable connecting means comprises holding parts and locking means on said recess-free plate and recesses on said other plate into which is received said holding parts and said locking means.

* * * * *